US005868956A

United States Patent [19]

Yamamura et al.

[11] Patent Number: 5,868,956

[45] Date of Patent: Feb. 9, 1999

[54] NOZZLE FOR USE IN CONTINUOUS CASTING OF STEEL

[75] Inventors: Takashi Yamamura; Osamu Nomura; Makoto Nakamura; Wei Lin; Ryosuke Nakamura, all of Okayama, Japan

[73] Assignee: Shinagawa Refractories Co., Ltd., Tokyo, Japan

[21] Appl. No.: 889,811

[22] Filed: Jul. 8, 1997

[51] Int. Cl.[6] ..... B22D 41/50

[52] U.S. Cl. ..... 222/606; 501/89

[58] Field of Search ..... 222/606, 607, 222/594; 266/236; 501/89

[56] References Cited

U.S. PATENT DOCUMENTS

| | | | |
|---|---|---|---|
| 3,801,083 | 4/1974 | Mantey et al. | 266/236 |
| 4,682,718 | 7/1987 | Watanabe et al. . | |
| 5,171,495 | 12/1992 | Luhrsen et al. | 501/89 |
| 5,571,440 | 11/1996 | Eckert | 222/594 |
| 5,691,061 | 11/1997 | Hanse et al. | 222/606 |

FOREIGN PATENT DOCUMENTS

| | | |
|---|---|---|
| 0 354 304 | 2/1990 | European Pat. Off. . |
| 1 433 635 | 4/1976 | United Kingdom . |

OTHER PUBLICATIONS

Database WPI, Section Ch, Week 9304, Derwent Publications Ltd., London GB; AN 93–034061 XP002040618 & SU 1 715 483 A (Ferrous Metallurgy Inst.), 29 Feb. 1992. *abstract*.

Patent Abstracts Of Japan, vol. 016, No. 034 (M–1204), 28 Jan. 1992 & JP 03 243258 A (Nisshin Steel Co. Ltd.), 30 Oct. 1991, *abstract*.

Patent Abstracts Of Japan, vol. 012, No. 352 (M–744), 21 Sep. 1988 & JP 63 112057 A (Nippon Steel Corp.), 17 May 1988, *abstract*.

Patent Abstracts Of Japan, vol. 006, No. 020 (M–110), 5 Feb. 1982 & JP 56 139260 A (Shinagawa Refract. Co. Ltd.), 30 Oct. 1981, *abstract*.

Patent Abstracts Of Japan, vol. 013, No. 365 (M–859), 15 Aug. 1989 & JP 01 122644 A (Toshiba Ceramics Co. Ltd.; Others: 01), 15 May 1989, *abstract*.

*Primary Examiner*—Scott Kastler

*Attorney, Agent, or Firm*—Wenderoth, Lind & Ponack, L.L.P.

[57] ABSTRACT

A nozzle for use in continuous casting of steel includes a refractory of at least the interior surface of the nozzle and/or the portions to come into contact with molten steel that is composed of an $Al_2O_3$-$SiO_2$ refractory material.

12 Claims, 3 Drawing Sheets

NOZZLE FOR USE IN CONTINUOUS CASTING OF STEEL

BACKGROUND OF THE INVENTION

Field of the Invention

The present invention relates to nozzles used in continuous casting of steel such as submerged nozzles, long nozzles and the likes.

Description of the Related Art $Al_2O_3$-$SiO_2$-C nozzles have been the most widely used in the continuous casting of aluminum killed steel because of their superior resistance to corrosion and spalling. However, clogging inside the nozzle pipe remains a problem due to the adhesion of $Al_2O_3$ inclusions caused by deoxidization of aluminum in the steel.

The clogging mechanism is as follows:

Firstly, at a high temperature, Reaction (1) occurs between the $SiO_2$ and C used as the raw materials in $Al_2O_3$-$SiO_2$-C refractories, then gaseous SiO and gaseous CO generated diffuse to the molten steel and react with the Al in the steel according to Reactions (2) and (3), to form a layer of $Al_2O_3$ network on the inner wall of the nozzle, which initiates the adhesion of $Al_2O_3$ inclusions in the molten steel.

$$SiO_2(s)+C(s)=SiO(g)+CO(g) \quad (1)$$

$$3SiO(g)+2\underline{Al}=Al_2O_3(S)+3\underline{Si} \quad (2)$$

$$3CO(g)+2\underline{Al}=Al_2O_3(S)+3\underline{C} \quad (3)$$

where (g) stands for gaseous phase, (s) stands for solid phase, and $\underline{Al}$, $\underline{Si}$, and $\underline{C}$ represent Al, Si, and C dissolved in the molten steel, respectively.

As the adhesion of $Al_2O_3$ inclusions progresses, nozzle clogging will occur. This not only shortens the working life of the nozzle, but also impedes continuous casting operation. Therefore, it is important to prevent nozzle clogging.

To try to solve the above problem, Japanese Patent Laid-Open No. 51-54836 discloses a method of coating the interior surface of a submerged nozzle with a refractory containing no carbon with the aim of preventing Reaction (1), in other words, the inner surface of the nozzle runner is covered with a refractory containing one or more of $Al_2O_3$, $MnO_2$, MgO, CaO, or $SiO_2$. However, in the range of 90 to 99 percent by weight of $SiO_2$ considered desirable in such publication $SiO_2$ is reduced by $\underline{Al}$ as shown in Reaction (4) and a layer of $Al_2O_3$ network is formed in a similar way to Reactions (1) to (3) above, which initiates the adhesion of $Al_2O_3$ inclusions.

$$3SiO_2(s)+4\underline{Al}=2A_2O_3(s)+3\underline{Si} \quad (4)$$

The $Al_2O_3$ thus formed and the $Al_2O_3$ inclusions in the steel adhere to the surface of the $SiO_2$ then dissolve into the $SiO_2$ and form a layer with a melting point less than 1600° C. In continuous casting, this layer with a low melting point is swept away by the molten steel causing damage to the nozzle.

As a countermeasure to this, Japanese Patent Laid-Open No. 3-243258 discloses a carbonless high alumina refractory having 90 percent by weight or more of $Al_2O_3$ (or MgO or $ZrO_2$) and containing not more than 5 percent by weight of $SiO_2$. Further, Japanese Patent Laid-Open No. 5-154628 discloses a nozzle for use in continuous casting whose interior body is composed mainly of alumina clinker with an alumina content of at least 99 percent by weight, having a refractory component with an alumina content of at least 70 percent by weight, a carbon content of less than 1 percent by weight, and a silica content of less than 1 percent by weight, and having a grain constitution in which 20 to 70 percent of the grains are 0.21 mm or less.

These interior bodies can be made by simultaneously pressure molding the raw material mix of the interior body and the raw material mix of the main body of the nozzle, or by packing the raw material mix of the interior body onto the preformed main body of the nozzle to finish it. In either method, the coefficient of thermal expansion of the carbonless material used to fill the interior body is markedly greater than the coefficient of thermal expansion of the carbonaceous material in the main body of the nozzle and cracks may form in the nozzle matrix during preheating and during use.

To overcome this, Japanese Patent Laid-Open No. 8-57601 discloses a nozzle for use in continuous casting characterized in that in the latter manufacturing process, where the main body of a nozzle for use in continuous casting is formed from a refractory material containing a source of carbon and the portions through which molten steel will flow or with which molten steel will come into contact are coated with a refractory material containing no carbon source, said portions being coated with a refractory material containing no carbon source are the interior wall, the bottom of the hole, the discharge portions, and the external portions to be immersed in molten steel, and said coated portions are formed into a cylindrical shape from refractory material containing no carbon, and further said cylindrical shaped body is constructed with joints which are 0.5 to 2.0 mm wide in said straight wall portions and 1 to 5 mm wide in said bottom and discharge portions. However, in this case, molten steel can penetrate the joints and cause the interior lining to peel away during casting.

Thus, the object of the present invention is to provide a nozzle for use in continuous casting of steel which not only reduces the adhesion of $Al_2O_3$ inclusions, but maintains a superior resistance to spalling and other heat damage.

SUMMARY OF THE INVENTION

The present invention is characterized in that, in a nozzle for use in continuous casting of steel, the refractory of at least the interior surface of the nozzle and/or the portions to come into contact with molten steel is composed of an $Al_2O_3$-$SiO_2$ refractory material.

In the first embodiment of the nozzle for use in continuous casting of steel (hereinafter simply "the nozzle") of the present invention, the $Al_2O_3$-$SiO_2$ refractory material has a chemical composition of 72 to 90 percent by weight of $Al_2O_3$, 10 to 28 percent by weight of $SiO_2$, and 5 percent by weight or less of unavoidable impurities, and its major mineral phase is composed of mullite alone, or mullite and corundum and/or β-alumina.

In the second embodiment of the nozzle of the present invention, the $Al_2O_3$-$SiO_2$ refractory material has a chemical composition of 5 to 10 percent by weight of $SiO_2$, 90 to 95 percent by weight of $Al_2O_3$, and 2 percent by weight or less of unavoidable impurities, and its major mineral phase is composed of mullite and corundum and/or β-alumina.

DETAILED DESCRIPTION OF THE INVENTION

Figure 1:
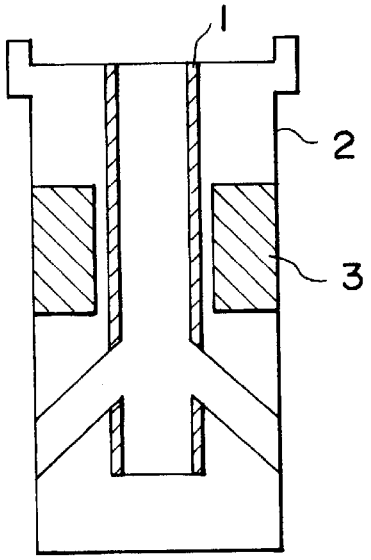
FIG. 1 shows an embodiment of the distribution of materials in the nozzle of the present invention.

In the first embodiment of the present invention, the refractory of at least the interior surface of the nozzle and/or the portions to come into contact with molten steel is an $Al_2O_3$-$SiO_2$ refractory material with a chemical composition of 72 to 90 percent by weight of $Al_2O_3$, 10 to 28 percent by weight of $SiO_2$, and 5 percent by weight or less of unavoidable impurities, and a major mineral phase composed of (1) mullite alone, or (2) mullite and corundum, or (3) mullite, corundum and β-alumina, or (4) mullite and β-alumina.

If the $Al_2O_3$ content in this $Al_2O_3$-$SiO_2$ refractory material is greater than 90 percent by weight, the ratio of alumina materials in the refractory becomes too great and spalling resistance tends to decline as the $Al_2O_3$ content is increased. In additon, if the $Al_2O_3$ content is less than 72 percent by weight, because $SiO_2$ minerals (quartz, cristobalite, etc.) or silica glass interact despite the mullite and alumina raw materials, Reaction (4) takes place, and the adhesion of alumina increases. Similarly, the $SiO_2$ content should not be greater than 28 percent by weight, because the $SiO_2$ minerals and silica glass interact; and spalling resistance tends to decline if it is less than 10 percent by weight. Some unavoidable impurities may be present in the $Al_2O_3$-$SiO_2$ refractory material, such as impurities resulting from the addition of binders, etc., during preparation of the raw material mix (C, CaO, etc.), or from the raw starting materials ($TiO_2$, MgO, or $Na_2O$, $K_2O$, etc., contained in β-alumina), but these can be tolerated if they total 5 percent by weight or less.

Examples of raw materials which can be used to form the $Al_2O_3$-$SiO_2$ refractory material in the first embodiment of the present invention are silica (cristobalite, quartz, silica glass, etc.), mullite, and alumina (corundum, β-alumina). All of the above raw materials may be used in either electromelted or sintered form.

The grain size of the starting materials should be 500 μm or less, and at least 80 percent by weight of the grains should preferably be 1 to 500 μm. If the maximum grain size is greater than 500 μm, the maximum grain diameter will be too big compared to the thickness of the nozzle, which will cause the refractory structure to be come brittle, and will cause grains to fall out, etc., during use. No more than 20 percent by weight of the grains should be less than 1 μm, otherwise sintering occurs during use and spalling resistance declines.

In the second embodiment of the present invention, the refractory material of at least the interior surface of the nozzle and/or the portions to come into contact with molten steel is an $Al_2O_3$-$SiO_2$ refractory material with a chemical composition of 5 to 10 percent by weight of $SiO_2$, 90 to 95 percent by weight of $Al_2O_3$, and 2 percent by weight or less of unavoidable impurities, and a major mineral phase composed of (1) mullite and corundum, (2) mullite, corundum and β-alumina, or (3) mullite and β-alumina.

Although the $Al_2O_3$-$SiO_2$ refractory material of the second embodiment contains a slightly higher ratio of $Al_2O_3$ than the $Al_2O_3$-$SiO_2$ refractory material of the first embodiment described above and therefore has slightly inferior spalling resistance, it can be used as a refractory material for the interior surface of the nozzle and/or the portions to come into contact with molten steel without any particular problem. The $SiO_2$ content should not be less than 5 percent by weight, or the $Al_2O_3$ content more than 95 percent by weight, because the ratio of silica in the refractory will be too low, or the ratio of alumina too high, and the refractory spalling resistance will decline markedly.

As is well known, the spalling resistance of $Al_2O_3$-$SiO_2$ refractory material improves as the $SiO_2$ content increases, or the $Al_2O_3$ content decreases. However, when the $SiO_2$ content is more than 10 percent by weight, or the $Al_2O_3$ content is less than 90 percent by weight, nozzle cloggings tend to increase as described in the comparative examples below.

Some unavoidable impurities may be present in the $Al_2O_3$-$SiO_2$ refractory material, such as impurities resulting from the addition of binders, etc., during preparation of the raw material mix (C, CaO, etc.), or from the starting materials ($TiO_2$, MgO, or $Na_2O$, $K_2O$, etc., contained in β-alumina), but these can be tolerated if they total 2 percent by weight or less.

Examples of raw materials which can be used to form the $Al_2O_3$-$SiO_2$ refractory material in the second embodiment of the present invention are silica (cristobalite, quartz, silica glass, etc.), mullite, and alumina (corundum, β-alumina), as well as raw materials composed mainly of $Al_2O_3$ and $SiO_2$. All of the above raw materials may be used in electromelted, sintered or natural form.

The grain size of the starting materials should be 1000 μm or less, and at least 80 percent by weight of the grains should preferably be 500 μm or less. If the grain size is greater than 1000 μm, or the ratio of grains over 500 μm is greater than 20 percent by weight, the grain diameter will be too large compared to the thickness of the nozzle, which will cause the refractory structure to become brittle, and will cause grains to fall out, etc., during use.

As explained above, the $Al_2O_3$-$SiO_2$ refractory material used in at least the interior surface of the nozzle according to the present invention and/or the portions of the nozzle to come into contact with molten steel is essentially composed of $Al_2O_3$ and $SiO_2$, and carbon is essentially absent, so that Reactions (1) to (3) above can be reduced and thus nozzle clogging by alumina inclusions can be prevented.

Also, in the above $Al_2O_3$-$SiO_2$ refractory material, because the $SiO_2$ is not present as a simple substance, but is instead contained in mullite ($Al_2O_3 \cdot SiO_2$), the thermodynamic activity of the $SiO_2$ is remarkably low, and the reactivity between Al in the molten steel and $SiO_2$ in the refractory material according to the reaction given in Reaction (4) above is also remarkably low. As a result, by employing mullite as a nozzle material, adhesion of alumina caused by reaction between.molten steel and refractory material can be reduced significantly. Further, at the extreme surface of the $Al_2O_3$-$SiO_2$ refractory material where it comes in contact with the molten steel, the molten steel is kept out by the alumina component after the $SiO_2$ has reacted and leached out, and so the reaction does not progress into the $Al_2O_3$-$SiO_2$ refractory material. Consequently, the reaction between Al in the molten steel and $SiO_2$ in the refractory material peters out.

As mentioned above, the $Al_2O_3$-$SiO_2$ refractory material used in the nozzle according to the present invention can be used for the entire body of any long nozzle, submerged nozzle, or other nozzle used in continuous casting, or it can be applied only to the interior surface and/or the portions to come into contact with molten steel.

When the entire body is to be composed solely of the $Al_2O_3$-$SiO_2$ refractory material, the raw refractory materials can be mixed with a phenolic resin or polysaccharide such as molasses, etc., as a binder, formed into the required nozzle shape by cold isostatic pressing, etc., then dried and fired. The raw refractory materials can also be cast or injection molded, dried, and fired where necessary.

Some contamination may occur depending on the type of binder, such as carbon resulting from a binder such as phenolic resin or CaO resulting from cement, for instance, but since their quantity is small, these can be regarded as unavoidable impurities. These unavoidable impurities will not pose any particular problem if they remain 5 percent by weight or less in the case of the first embodiment and 2 percent by weight or less in the case of the second embodiment.

When the $Al_2O_3$-$SiO_2$ refractory material is used on the interior surface of the nozzle and/or the portions to come into contact with molten steel, the interior surface and/or the portions to come into contact with molten steel may be manufactured either by simultaneously pressure molding the raw material mix of the $Al_2O_3$-$SiO_2$ refractory material composing these portions and the raw material mix of the refractory material composing the main body of the nozzle into the required nozzle shape (simultaneous molding), or by packing the raw material mix of the $Al_2O_3$-$SiO_2$ refractory material composing the interior surface of the nozzle and/or the portions to come into contact with molten steel onto the preformed main body of the nozzle to finish it (finishing). Conventional refractory materials, such as alumina-carbon, zirconia-carbon, etc., can be used for the main body of the nozzle.

Figure 2:
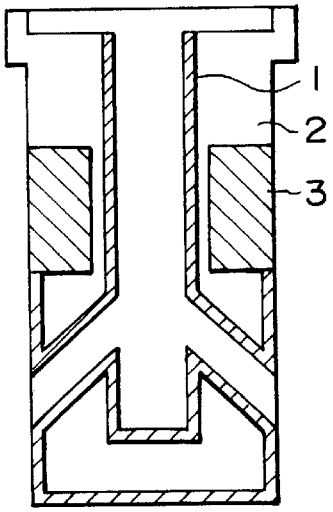
FIG. 2 shows another embodiment of the distribution of materials in the nozzle of the present invention.
Figure 3:
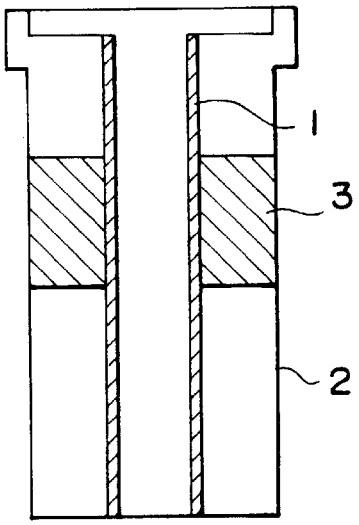
FIG. 3 shows another embodiment of the distribution of materials in the nozzle of the present invention.

Several examples of the distribution of materials in the nozzle of the present invention are given in FIGS. 1 to 4. FIGS. 1 to 3 show submerged nozzles with $ZrO_2$-C refractory material (3) arranged around the powder line. The powder line is the portion which comes into contact with the highly corrosive mold powder when the submerged nozzle is used, and the $Al_2O_3$-C refractory material (2) composing the main body of the nozzle has been replaced in this region by the $ZrO_2$-C refractory material (3), which has superior corrosion resistance, to reinforce the powder line. $Al_2O_3$-C refractory materials and $ZrO_2$-C refractory materials of ordinary composition can be used, for instance, $Al_2O_3$-C refractory material composed of 30 to 90 percent by weight of $Al_2O_3$, 0 to 35 percent by weight of $SiO_2$, and 10 to 35 percent by weight of C, or $ZrO_2$-C refractory material composed of 66 to 88 percent by weight of $ZrO_2$, 2 to 4 percent by weight of CaO, and 10 to 30 percent by weight of C. Usually, CaO stabilized $ZrO_2$ is the most widely used form of $ZrO_2$, but MgO stabilized $ZrO_2$, $Y_2O_3$ stabilized $ZrO_2$, baddeleyite, etc.., may also be used. Also, in FIGS. 1 to 4, $Al_2O_3$-$SiO_2$ refractory material (1) has been disposed around the interior surface of the nozzle and those portions to come into contact with molten steel. It should be understood that the distribution of materials in the nozzle of the present invention should in no way be limited to those described in FIGS. 1 to 4.

When a nozzle having a diverse distribution of materials is manufactured by simultaneous molding, the raw material mix of the alumina-carbon or other refractory material composing the main body of the nozzle which has been mixed with a phenolic resin or polysaccharide such as molasses, etc.., as a binder, and the raw material mix of the $Al_2O_3$-$SiO_2$ refractory material composing the interior surface of the nozzle and/or the portions to come into contact with molten steel can be packed into their required positions in the mold, then formed by cold isostatic pressing, etc.., dried, and used unfired or fired.

When a nozzle having a diverse distribution of materials is manufactured by finishing, a blended raw material mix containing water soluble binders such as cement, silicate, phosphate, etc., can be cast molded or injection molded around the main body of a nozzle which has been preformed by an ordinary method, which is then dried and, where necessary, fired, or pressure, cast, or injection molded interior portions (interior surface and/or portions to come into contact with molten steel) can be loaded into the main body of a nozzle which has been preformed by an ordinary method.

When the nozzle of the present invention is made of $Al_2O_3$-$SiO_2$ refractory material only, or when a nozzle having a diverse distribution of materials is manufactured by simultaneous molding and fired, silica raw materials can be used, but it is necessary to react the alumina raw materials with the silica raw materials sufficiently to produce mullite, which requires a firing temperature of at least 1200° C. However, there is a possibility that silica raw materials will remain if the mullite producing reaction is incomplete, and so it is preferable to use mullite and alumina raw materials as the starting materials. In that case, there is no particular problem if the unfired product is dried at a temperature of at least 250° C. MgO, $TiO_2$, and other unavoidable impurities in the starting materials should be kept at 2 percent by weight or less to prevent excessive sintering during use of the submerged nozzle.

When $Al_2O_3$-$SiO_2$ refractory material is used with other refractories in a diverse distribution of materials, the thickness of the $Al_2O_3$-$SiO_2$ refractory material should be in the range of 2 to 10 mm. It is not desirable for said thickness to be less than 2 mm because the refractory material could melt during use and be unable to perform its desired finction, and it is not desirable for the thickness to be greater than 10 mm because cracks form as a result of differences in coefficient of expansion between it and the refractory material composing the main body of the nozzle (reduced spalling resistance).

Using the nozzle of the present invention, nozzle blockages due to the adhesion of $Al_2O_3$ inclusions during the casting of aluminum killed steel can be significantly reduced and aluminum killed steel can thus be cast continuously for longer periods.

EXAMPLES

The present invention will be illustrated in more detail by the following examples. However, it is to be understood that the invention is not intended to be limited by the examples.

The spalling tests and alumina adhesion tests performed on each of the samples in the examples and comparisons below will now be explained.

In the spalling tests in the examples below, the samples were heated to 1500° C. in an electric furnace, then evaluated on the basis of crack formation on cooling. Ten samples were prepared and were evaluated by the total number of samples in which cracks had formed.

In the alumina adhesion tests, 1 percent by weight of aluminum was dissolved in molten steel at 1550° C., then samples were immersed therein for 60 minutes and evaluated for alumina adhesion. Evaluation was based on the thickness of the alumina adhesion on the immersed portion.

EXAMPLE 1

Phenolic resin or molasses was added as a binder to the mixture of starting materials shown in Table 1 below, blended, molded by cold isostatic pressing at 1000 kgf/cm$^2$, dried for 3 hours at 250° C., then fired for 3 hours at 1400° C. to obtain test samples having an internal diameter of 30 mm, an external diameter of 55 mm, and a length of 400 mm. The refractory property was evaluated by measuring physical properties and performing alumina adhesion and spalling tests.

TABLE 1

| | Inventive Product | | | | | Comp. Product | | |
|---|---|---|---|---|---|---|---|---|
| | 1 | 2 | 3 | 4 | 5 | 1 | 2 | 3 |
| Mix: | | | | | | | | |
| Corundum (1 to 300 μm) | — | 28 | 10 | — | — | 92 | — | — |
| Corundum (<1 μm) | — | 8 | 8 | — | — | 8 | — | — |
| Mullite (1 to 300 μm) | 54 | 64 | 82 | 92 | 92 | — | 84 | — |
| Mullite (<1 μm) | 10 | — | — | 8 | 8 | — | 8 | — |
| β-alumina (1 to 300 μm) | 36 | — | — | — | — | — | — | — |
| Silica Glass (1 to 300 μm) | — | — | — | — | — | — | 8 | — |
| Binder | T | T | F | F | T | T | T | T |
| Chemical composition: | | | | | | | | |
| $Al_2O_3$ (wt %) | 89 | 90 | 76 | 71 | 72 | 99 | 66 | 41 |
| $SiO_2$ (wt %) | 10 | 10 | 23 | 27 | 28 | 1 | 34 | 28 |
| $Na_2O$ (wt %) | 1 | — | — | — | — | — | — | — |
| C (wt %) | — | — | 1 | 2 | — | — | — | 31 |
| Mineral phase after firing | M,β | M,A | M,A | M | M | A | M,C | A,G,C |
| Physical properties: | | | | | | | | |
| Porosity (%) | 16.0 | 15.0 | 16.5 | 20.0 | 23.0 | 18.0 | 21.0 | 14.5 |
| Bulk density (g/cm$^3$) | 3.00 | 3.05 | 2.62 | 2.45 | 2.40 | 3.10 | 2.40 | 2.25 |
| Flexural strength (MPa) | 9.0 | 9.5 | 9.0 | 9.0 | 5.0 | 10.0 | 7.0 | 8.0 |
| Coefficient of thermal expansion (%) | 0.6 | 0.6 | 0.5 | 0.5 | 0.5 | 0.8 | 0.5 | 0.3 |
| Alumina adhesion | 1.5 | 1.5 | 1.5 | 1.5 | 2.0 | 1.0 | 4.5 | 8.0 |
| Spalling test | 0 | 0 | 0 | 0 | 0 | 7 | 0 | 0 |

In Table 1, the symnbols in the Binders are: T = molasses; and F = phenolic resin. The symbols in the Mineral phases after firing are: A = corundum; β = β-alumina; C = cristobalite; G = graphite; and M = mullite. The flexural strength in Table 1 was measured at 1400° C., and the coefficient of thermal expansion was measured at 1000° C.

The spalling resistance in the sample containing 99 percent by weight of $Al_2O_3$ was markedly inferior, but it was clear that spalling resistance improved as $SiO_2$ content was increased. However, when the $SiO_2$ content exceeded 28 percent by weight, silica phase arose in the refractory and alumina adhesion increased.

EXAMPLE 2

Phenolic resin was added as a binder to the mixture of starting materials shown in Table 2 below, blended, molded by cold isostatic pressing at 1000 kgf/cm$^2$, dried for 3 hours at 250° C., then fired for 3 hours at 1400° C. to obtain test samples having an internal diameter of 30 mm, an external diameter of 55 mm, and a length of 400 mm. The refractory property was evaluated by measuring physical properties and performing alumina adhesion and spalling tests. The flexural strength in Table 2 was measured at 1400° C., and the coefficient of thermal expansion was measured at 1000° C.

TABLE 2

| | Inventive Product | | | Comparative Product | |
|---|---|---|---|---|---|
| | 3 | 6 | 7 | 4 | 5 |
| Mix: | | | | | |
| Corundum (300 to 500 μm) | — | — | — | — | — |
| Corundum (1 to 300 μm) | 10 | 10 | — | — | — |
| Corundum (<1 μm) | 8 | 8 | 18 | 18 | 18 |
| Mullite (500 to 1000 um) | — | — | — | — | 5 |
| Mullite (300 to 500 μm) | — | 10 | 10 | 10 | 10 |
| Mullite (1 to 300 μm) | 82 | 72 | 72 | 67 | 67 |
| Mullite (<1 μm) | — | — | — | 5 | — |
| Chemical composition: | | | | | |
| $Al_2O_3$ (wt %) | 76 | 76 | 76 | 76 | 76 |
| $SiO_2$ (wt %) | 23 | 23 | 23 | 23 | 23 |

TABLE 2-continued

| | Inventive Product | | | Comparative Product | |
|---|---|---|---|---|---|
| | 3 | 6 | 7 | 4 | 5 |
| C (wt %) | 1 | 1 | 1 | 1 | 1 |
| Mineral phase after firing | M,A | M,A | M,A | M,A | M,A |
| Physical properties: | | | | | |
| Porosity (%) | 16.5 | 16.5 | 16.1 | 15.7 | 16.2 |
| Bulk density (g/cm$^3$) | 2.62 | 2.63 | 2.64 | 2.65 | 2.63 |
| Flexural strength (MPa) | 9.0 | 9.0 | 9.0 | 9.5 | 8.5 |
| Coefficient of thermal expansion (%) | 0.5 | 0.5 | 0.5 | 0.5 | 0.5 |
| Alumina adhesion | 1.5 | 1.5 | 1.5 | 1.5 | 1.5 |
| Spalling test | 0 | 0 | 0 | 4 | 0(*) |

No effect could be seen on the spalling resistance, when the ratio of starting materials smaller than 1 μm was less than 20 percent by weight, but it was clear that spalling resistance declined if the ratio was increased to 28 percent by weight. When the maximum grain size exceeded 500 μm, grains fell out during the spalling test. Grain size had little effect on alumina adhesion. The symbol (*) in Table 2 indicates that some refractory particles fell out.

EXAMPLE 3

Figure 4:
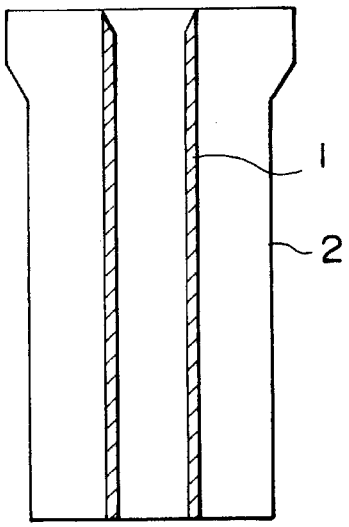
FIG. 4 shows another embodiment of the distribution of materials in the nozzle of the present invention.

Using a nozzle main body composed of the alumina-carbon refractory material of comparative product 3 above, submerged nozzles (external diameter of nozzle 130 mm, internal diameter 70 mm, length 600 mm) finished with the material of inventive product 3 were made with different thicknesses of finishing material (1 mm, 2 mm, 5 mm, 10 mm, and 12 mm, but nozzle thickness constant). The samples were simultaneously molded by cold isostatic pressing, dried for 3 hours at 250° C., then fired for 3 hours at 1000° C. The distribution of materials was as shown in FIG. 4.

The nozzle test samples thus obtained were immersed for 3 hours in steel containing 1 percent by weight of Al kept molten at 1550° C. by in a high frequency furnace, then compared for spalling resistance by crack formation, and for corrosion resistance by the amount of melt damage to the inside of the pipe. Ten test samples were prepared and spalling resistance was evaluated by the total number of test samples in which cracks had formed, corrosion resistance was evaluated by the average depth of melt damage to the inside of the pipe.

TABLE 3

| | Inventive Product | | | Comparative Product | |
|---|---|---|---|---|---|
| | 8 | 9 | 10 | 6 | 7 |
| Finish thickness (mm) | 2 | 5 | 10 | 1 | 12 |
| Melt loss (mm) | 1.5 | 1.0 | 1.0 | 1.0 | 1.5 |
| Spalling test | 0 | 0 | 0 | 0 | 5 |

As a result, it became clear that melt loss to the finish could occur during casting if the finish thickness was less than 2 mm, and that spalling resistance declined markedly if the thickness exceeded 10 mm.

EXAMPLE 4

Fired nozzles (main bodies) with an external diameter of 130 mm, an internal diameter of 70 mm, and a length of 600 mm were made using the alumina-carbon refractory material of comparison product 3 above and a $ZrO_2$-C refractory material (80 percent by weight of CaO stabilized $ZrO_2$, 20 percent by weight of graphite). A mix containing 17 percent by weight of corundum, 75 percent by weight of mullite (grain size 1 to 300 $\mu$m), and 8 percent by weight of high alumina cement (25 percent by weight of CaO; 75 percent by weight of $Al_2O_3$) was added to the inside of these and cast molded to a thickness of 5 mm as shown in FIG. 4. The molded bodies thus obtained were dried for 3 hours at 250° C, then fired for 3 hours at 1000° C. to make submerged nozzle test samples. The distribution of materials was as shown in FIG. 1. The composition of the $Al_2O_3$-$SiO_2$ refractory material thus obtained was 77 percent by weight of $Al_2O_3$, 21 percent by weight of $SiO_2$, and 2 percent by weight of CaO, the major mineral phases were mullite and corundum, and there was a small amount of $Al_2O_3$-$SiO_2$-CaO glass present.

The nozzle test samples thus obtained were evaluated for melt loss and spalling resistance by the same criteria as in Example 3 above.

TABLE 4

| | Inventive Product 11 |
|---|---|
| Finish thickness (mm) | 5 |
| Melt loss (mm) | 1.5 |
| Spalling test | 0 |

EXAMPLE 5

Figure 5:
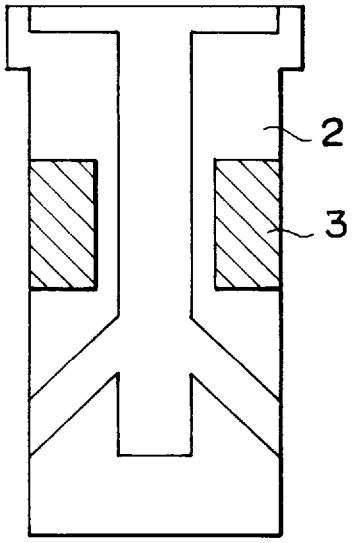
FIG. 5 shows the distribution of materials in a conventional nozzle.

An actual machine test run was conducted to evaluate the efficacy of the nozzle of the present invention. The submerged nozzle made for inventive product 9 above, was tested for comparison against a conventional nozzle made of a combination of the $Al_2O_3$-C refractory material of comparative product 3 and the $ZrO_2$-C refractory material used in Example 4 above with a distribution of materials as shown in FIG. 5.

The test used low carbon aluminum killed steel (composition (wt%): C=0.08; Si=0.03; Mn=0.2; P=0.01; S=0.001, Al=0.03) and was conducted at a casting temperature of 1580° C. After 210 minutes of casting, the thickness of the largest inclusion adhesion layer in the comparison nozzle was 12 mm, whereas in the submerged nozzle of inventive product 9 it was 4.8 mm, showing a significant reduction in alumina adhesion. As shown above, the refractory material of this embodiment of the invention has a porosity of 15.0 percent (Example 2) to 23.0 percent (Example 5).

EXAMPLE 6

Phenolic resin or molasses was added as a binder to the mixture of starting materials shown in Table 5 below, blended, molded by cold isostatic pressing at 1000 kgf/cm$^2$, dried for 3 hours at 250° C., then fired for 3 hours at 1400° C. to obtain test samples having an internal diameter of 30 mm, an external diameter of 55 mm, and a length of 400 mm. The refractory property was evaluated by measuring physical properties and performing alumina adhesion and spalling tests.

TABLE 5

| | Inventive Product | | | | Comparative Product | | | |
|---|---|---|---|---|---|---|---|---|
| | 12 | 13 | 14 | 15 | 8 | 9 | 10 | 11 |
| Mix: | | | | | | | | |
| Corundum (1 to 300 $\mu$m) | 74 | 63 | 56 | — | 92 | 10 | 38 | — |
| Corundum (<1 $\mu$m) | 8 | 8 | 8 | — | 8 | — | 8 | — |
| Mullite (1 to 300 $\mu$m) | 18 | 29 | 36 | 18 | — | — | 54 | — |
| Mullite (<1 $\mu$m) | — | — | — | 10 | — | — | — | — |
| β-alumina (1 to 300 $\mu$m) | — | — | — | 72 | — | — | — | — |
| Silica Glass (1 to 300 $\mu$m) | — | — | — | — | — | 90 | — | — |
| Binder | T | T | F | T | T | F | F | — |
| Chemical composition: | | | | | | | | |
| $Al_2O_3$ (wt %) | 95 | 92 | 90 | 90 | 99 | 10 | 85 | 41 |
| $SiO_2$ (wt %) | 5 | 8 | 10 | 8 | 1 | 90 | 15 | 28 |
| $Na_2O$ (wt %) | — | — | — | 2 | — | — | — | — |
| C (wt %) | — | — | — | — | — | — | — | 31 |
| Mineral phase after firing | M,A | M,A | M,A | M,β | A | M,C | M,C | A,G,C |

TABLE 5-continued

| | Inventive Product | | | | Comparative Product | | | |
|---|---|---|---|---|---|---|---|---|
| | 12 | 13 | 14 | 15 | 8 | 9 | 10 | 11 |
| Physical properties: | | | | | | | | |
| Porosity (%) | 15.5 | 15.0 | 15.0 | 14.8 | 18.0 | 14.5 | 15.0 | 14.5 |
| Bulk density (g/cm$^3$) | 3.08 | 3.06 | 3.05 | 3.04 | 3.10 | 2.50 | 3.00 | 2.25 |
| Flexural strength (MPa) | 9.2 | 9.0 | 9.5 | 9.5 | 10.0 | 6.0 | 8.8 | 8.0 |
| Coefficient of thermal expansion (%) | 0.7 | 0.65 | 0.6 | 0.6 | 0.8 | 0.50 | 0.60 | 0.3 |
| Alumina adhesion | 1.3 | 1.3 | 1.3 | 1.3 | 1.0 | 5.5* | 1.5* | 8.0 |
| Spalling test | 0 | 0 | 0 | 0 | 7 | 0 | 0 | 0 |

The symbol (*) in Table 5 indicates that some refractory fell out.

The spalling resistance in the samples containing 99 percent by weight of $Al_2O_3$ (comparative product 8) was markedly inferior, some refractory fell out of the samples containing 90 percent by weight and 15 percent by weight of $SiO_2$ (comparative products 9 and 10), and alumina adhesion was noticeably bad in the samples containing $Al_2O_3$-$SiO_2$-C.

However, in inventive products 12 to 15, resistance to both alumina adhesion and spalling was good, and refractory did not fall out.

EXAMPLE 7

Phenolic resin was added as a binder to the mixture of starting materials shown in Table 6 below, blended, molded by cold isostatic pressing at 1000 kgf/cm$^2$, dried for 3 hours at 250° C., then fired for 3 hours at 1400° C. to obtain test samples having an internal diameter of 30 mm, an external diameter of 55 mm, and a length of 400 mm. The refractory property was evaluated by measuring physical properties and performing alumina adhesion and spalling tests.

TABLE 6

| | Inventive Product | | | | Comparative Product | |
|---|---|---|---|---|---|---|
| | 16 | 17 | 18 | 19 | 12 | 13 |
| Mix: | | | | | | |
| Corundum (300 to 500 μm) | — | 15 | 15 | 15 | 15 | 15 |
| Corundum (<300 μm) | 71 | 56 | 56 | 56 | 56 | 56 |
| Mullite (>1000 μm) | — | — | — | — | 5 | — |
| Mullite (500 to 1000 um) | — | — | 5 | 15 | — | 24 |
| Mullite (300 to 500 μm) | — | 10 | 10 | 7 | 13 | 2 |
| Mullite (<300 μm) | 29 | 19 | 14 | 7 | 11 | 3 |
| Chemical composition: | | | | | | |
| $Al_2O_3$ (wt %) | 92 | 92 | 92 | 92 | 92 | 92 |
| $SiO_2$ (wt %) | 8 | 8 | 8 | 8 | 8 | 8 |
| Mineral phase after firing | M,A | M,A | M,A | M,A | M,A | M,A |
| Physical properties: | | | | | | |
| Porosity (%) | 15.5 | 15.0 | 15.2 | 15.5 | 15.7 | 15.4 |
| Bulk density (g/cm$^3$) | 3.06 | 3.05 | 3.03 | 3.01 | 3.00 | 3.01 |
| Flexural strength (MPa) | 9.0 | 9.0 | 8.9 | 8.8 | 8.5 | 8.6 |
| Coefficient of thermal expansion (%) | 0.65 | 0.64 | 0.64 | 0.61 | 0.60 | 0.61 |
| Alumina adhesion | 1.3 | 1.3 | I.3 | 1.3 | 1.3 | 1.3 |
| Spalling test | 0 | 0 | 0 | 0 | * | * |

The symbol (*) in the table indicates that some refractory fell out.

When the maximum grain size of the raw starting materials exceeded 1000 μm, or the ratio of grains of 500 μm or more exceeded 20 percent by weight, grains fell out of the nozzle samples. Thus, it was clear that the grain size of the raw materials should be less than 1000 μm, and the ratio of grains less than 500 μm should be at least 80 percent by weight.

EXAMPLE 8

Using a nozzle main body composed of the alumina-carbon refractory material of comparative product 11 shown in Table 5 above, submerged nozzles (external diameter of nozzle 130 mm, internal diameter 70 mm, length 600 mm) finished with the material of inventive product 13 shown in Table 5 were made with different thicknesses of finishing material (1 mm, 2 mm, 5 mm, 10 mm, and 12 mm, but nozzle thickness constant). The samples were simultaneously molded by cold isostatic pressing, dried for 3 hours at 250° C., then fired for 3 hours at 1000° C. The distribution of materials was as shown in FIG. 4.

The nozzle test samples thus obtained were immersed for 3 hours in steel containing 1 percent by weight of Al kept molten at 1550° C. by in a high frequency furnace, then compared for spalling resistance by crack formation, and for corrosion resistance by the amount of melt loss to the inside of the pipe. Ten test samples were prepared and spalling resistance was evaluated by the total number of test samples in which cracks had formed, corrosion resistance was evaluated by the average depth of melt loss to the inside of the pipe. The results are given in Table 7.

TABLE 7

| | Inventive Product | | | Comparative Product | |
|---|---|---|---|---|---|
| | 20 | 21 | 22 | 14 | 15 |
| Finish thickness (mm) | 2 | 5 | 10 | 1 | 12 |
| Melt loss (mm) | 1.5 | 1.0 | 1.0 | 1.0 | 1.0 |
| Spalling test | 0 | 0 | 0 | 0 | 5 |

It was clear from Table 7 that melt loss to the finish could occur during casting if the finish thickness was less than 2 mm, and that spalling resistance declined markedly if the thickness exceeded 10 mm.

EXAMPLE 9

Fired nozzles (main bodies) with an external diameter of 130 mm, an internal diameter of 70 mm, and a length of 600 mm were made using the alumina-carbon refractory material of comparative product 11 shown in Table 5 above and a $ZrO_2$-C refractory material (80 percent by weight of CaO stabilized $ZrO_2$, 20 percent by weight of graphite). A mix containing 64 percent by weight of corundum, 28 percent by weight of mullite (grain size 1 to 300 μm), and 8 percent by weight of high-alumina cement (25 percent by weight of CaO; 75 percent by weight of $Al_2O_3$) was added to the inside of these and cast molded to a thickness of 5 mm as shown in FIG. 4. The molded bodies thus obtained were dried for 3 hours at 250° C., then fired for 3 hours at 1000° C. to make submerged nozzle test samples.

The composition of the $Al_2O_3$-$SiO_2$ refractory material thus obtained was 90 percent by weight of $Al_2O_3$, 8 percent by weight of $SiO_2$, and 2 percent by weight of CaO, the major mineral phases were mullite and corundum, and there was a small amount of $Al_2O_3$-$SiO_2$-CaO glass present.

The nozzle test samples thus obtained were evaluated for melt loss and spalling resistance by the same criteria as in Example 8 above. The results are given in Table 8.

TABLE 8

| | Inventive product 23 |
|---|---|
| Finish thickness (mm) | 5 |
| Melt loss (mm) | 1.0 |
| Spalling test | 0 |

Comparing the results in Table 8 to those in Table 7, it was clear that no major damage would result if the unavoidable impurities in the refractory material were kept at 2 percent by weight or less.

EXAMPLE 10

As shown above, the refractory material of this embodiment of the invention has a porosity of 14.8 percent (Example 15) and 15.5 percent (Example 16).

An actual machine test run was conducted to evaluate the efficacy of the nozzle of the present invention. The submerged nozzle made for inventive product 20 shown in Table 7 above, was tested for comparison against a conventional nozzle made of a combination of the $Al_2O_3$-C refractory material of comparative product 11 in Table 5 and the $ZrO_2$-C refractory material used in Example 9 above with a distribution of materials as shown in FIG. 5.

The test used low carbon aluminum killed steel (composition (wt%): C=0.04; Si=0.03; Mn=0.2; P=0.01; S=0.01, Al=0.05) and was conducted at a casting temperature of 1580° C. After 210 minutes of casting, the thickness of the largest inclusion adhesion layer in the comparison nozzle was 12 mm, whereas in the submerged nozzle of inventive product 20 it was 2.0 mm, showing a significant reduction in alumina adhesion.

We claim:

1. A nozzle for use in the continuous casting of aluminum killed steel, said nozzle comprising:

at least one portion to come into contact with molten steel being formed of an $Al_2O_3$-$SiO_2$ refractory material having a chemical composition of 72 to 90 percent by weight of $Al_2O_3$, 10 to 28 percent by weight $SiO_2$, and 5 percent by weight or less of unavoidable impurities, and in which a major mineral phase is composed of (1) mullite alone, or (2) mullite and corundum, or (3) mullite, corundum and β-alumina, or (4) mullite and β-alumina; and said portion to come into contact with molten metal having a porosity of 15.0 to 23.0 percent.

2. A nozzle as claimed in claim 1, wherein said refractory material is formed from mullite as a raw refractory starting material containing $SiO_2$.

3. A nozzle as claimed in claim 1, wherein said refractory material is formed from raw refractory starting materials having a grain size of 500 μm or less and in which the percentage of grains having a grain size of 1 to 500 μm is at least 80 percent by weight.

4. A nozzle as claimed in claim 1, wherein said portion to come into contact with molten metal comprises an interior surface of said nozzle.

5. A nozzle as claimed in claim 1, wherein all portions of said nozzle to come into contact with molten metal are formed of said refractory material.

6. A nozzle as claimed in claim 1, wherein said portion to come into contact with molten material has a thickness of 2 to 10 mm.

7. A nozzle for use in the continuous casting of aluminum killed steel, said nozzle comprising:

at least one portion to come into contact with molten steel being formed of an $Al_2O_3$-$SiO_2$ refractory material having a chemical composition of 90 to 95 percent by weight of $Al_2O_3$, 5 to 10 percent by weight $SiO_2$, and 2 percent by weight or less of unavoidable impurities, and in which a major mineral phase is composed of (1) mullite and corundum, or (2) mullite, corundum and β-alumina, or (3) mullite and β-alumina; and said portion to come into contact with molten metal having a porosity of 14.8 to 15.5 percent.

8. A nozzle as claimed in claim 7, wherein said refractory material is an unfired product formed from mullite as a raw refractory starting material containing $SiO_2$.

9. A nozzle as claimed in claim 7, wherein said refractory material is formed from raw refractory starting materials having a grain size of 1000 μm or less and in which the percentage of grains having a grain size of 500 μm or less is at least 80 percent by weight.

10. A nozzle as claimed in claim 7, wherein said portion to come into contact with molten metal comprises an interior surface of said nozzle.

11. A nozzle as claimed in claim 7, wherein all portions of said nozzle to come into contact with molten metal are formed of said refractory material.

12. A nozzle as claimed in claim 7, wherein said portion to come into contact with molten material has a thickness of 2 to 10 mm.

* * * * *